US007173540B2

(12) United States Patent
Daigle et al.

(10) Patent No.: US 7,173,540 B2
(45) Date of Patent: Feb. 6, 2007

(54) FLASH-BANG PROJECTILE

(75) Inventors: Marc Daigle, Concord, MA (US); Heidi Burnham, Groton, MA (US)

(73) Assignee: Optical Alchemy, Inc., Maynard, MA (US)

( * ) Notice: Subject to any disclaimer, the term of this patent is extended or adjusted under 35 U.S.C. 154(b) by 130 days.

(21) Appl. No.: 10/641,338

(22) Filed: Aug. 14, 2003

(65) Prior Publication Data

US 2005/0188885 A1 Sep. 1, 2005

Related U.S. Application Data

(60) Provisional application No. 60/403,492, filed on Aug. 14, 2002.

(51) Int. Cl.

| | |
|---|---|
| ***G08B 5/38*** | (2006.01) |
| ***G08B 3/02*** | (2006.01) |
| ***H02N 2/18*** | (2006.01) |
| ***F21L 13/06*** | (2006.01) |

(52) U.S. Cl. ..... 340/815.83; 340/385.1; 340/326; 102/209; 102/210; 102/502; 102/531; 473/570; 473/571; 362/203; 124/27; 124/75; 310/339

(58) Field of Classification Search ..... 340/385.1; 124/71, 74, 75; 102/439, 502, 531; 362/203; 473/570, 571

See application file for complete search history.

(56) References Cited

U.S. PATENT DOCUMENTS 2,247,111 A * 6/1941 Batchelor et al. ..... 102/501
2,544,077 A * 3/1951 Gardner ..... 310/15
2,655,867 A * 10/1953 Jordan ..... 102/209
3,418,995 A * 12/1968 Heller ..... 124/27
3,726,266 A * 4/1973 Palmer ..... 124/59
4,665,332 A * 5/1987 Meir ..... 310/77

(Continued)

*Primary Examiner*—Jeffery Hofsass
*Assistant Examiner*—Anne V. Lai
(74) *Attorney, Agent, or Firm*—BainwoodHuang

(57) ABSTRACT

A flash-bang projectile that generates one or more noise pulses and one or more flashes of light. In generating a noise pulse, the flash-bang projectile provides a housing that includes a gas chamber that entraps air. The gas chamber includes a compression device that, when the flash-bang projectile is shot or otherwise ejected by a gun or other form of ejection device, compresses the air that is entrapped in the gas chamber. A burst disk forms one wall of the gas chamber and is configured to rupture a selected time delay after the air has been compressed. Rupturing of the burst disk releases the compressed air entrapped in the gas chamber, allowing the air to be released through a horn nozzle, thereby generating a noise pulse. The flash-bang projectile may have more than one gas chambers, with associated compression devices, whose burst disks are configured to rupture with diverse time delays, in which case the flash-bang projectile can generate multiple noise pulses with corresponding delays. In generating a light flash, the flash-bang projectile includes one or more light generating devices, which may include items such as flash lamps, light-emitting devices, and the like, along with a control module for powering the light generating devices. The control module includes an electrical generating arrangement that uses a portion of the kinetic energy imparted to the flash-bang projectile when it is ejected to generate electrical energy. The electrical energy is, in turn, used to power the light generating devices. Electrical traces on the burst disks are broken when the burst disks rupture to facilitate synchronization of the light flashes with the noise pulses.

28 Claims, 3 Drawing Sheets

U.S. PATENT DOCUMENTS 4,862,021 A * 8/1989 LaRocca ..... 310/10
5,134,552 A * 7/1992 Call et al. ..... 362/203
5,141,229 A * 8/1992 Roundy ..... 473/570
5,157,405 A * 10/1992 Wycoff et al. ..... 342/386
5,365,913 A * 11/1994 Walton ..... 124/75
5,425,542 A * 6/1995 Blackwood et al. ..... 473/570
5,536,990 A * 7/1996 Nelson ..... 310/339
6,257,146 B1 * 7/2001 Stonebraker ..... 102/346
6,289,815 B1 * 9/2001 Tougeron et al. ..... 102/302
6,361,393 B1 * 3/2002 Seymour ..... 446/34
6,390,642 B1 * 5/2002 Simonton ..... 362/203
6,575,098 B2 * 6/2003 Hsiung ..... 102/498

* cited by examiner

FLASH-BANG PROJECTILE

CROSS-REFERENCE TO RELATED APPLICATION

This application claims the benefit of co-pending U.S. Provisional Patent Application Ser. No. 60/403,492 filed on Aug. 14, 2002, which is fully incorporated herein by reference.

FIELD OF THE INVENTION

The application relates generally to the field of projectiles, and more particularly to "flash-bang" projectiles.

BACKGROUND OF THE INVENTION

"Flash-bang" projectiles are used in a number of environments, including, for example, crowd control, hostage situations, games, and the like. Generally, flash-bang projectiles, after being thrown, shot, or the like, explode to provide a loud burst of noise (a "bang") and a bright flash of light. If the projectile is directed towards a group of people, for example, a crowd, hostage-takers or the like, the noise burst and flash of light typically serve to surprise and confuse the people in the group, after which authorities may be able to move in and control the crowd, disarm a hostage-taker, or the like, with a minimum of problems.

It is typically preferable to use flash-bang projectiles instead of conventional crowd-control measures, and so forth, since they generally can be used in such a manner as to avoid killing or seriously injuring the people toward whom they are directed, or seriously damaging property in the surrounding area. Problems can arise, however, when conventional flash-bang projectiles are used. For example, conventional flash-bang projectiles typically make use of an explosive charge that, when it is detonated, provides the flash and the bang. When such flash-bang projectiles explode, the explosive charges have been known to start fires, which can injure or even kill the people toward whom they are directed. In addition, the debris from the explosion may injure people or damage property. Moreover, typically the person who is using the flash-bang projectile needs to actuate a timer on the flash-bang projectile that, at the end of a predetermined time period, will in turn actuate a detonator to detonate the charge. Accordingly, a problem can arise if the user does not release the projectile fairly quickly after he or she actuates the timer.

SUMMARY OF THE INVENTION

The invention provides a new and improved "flash-bang" projectile that overcomes the problems of conventional flash-bang projectiles, and that can also provide additional advantages. A flash-bang projectile according to the invention does not make use of an explosive charge, and so the possibility that it might start a fire is significantly reduced, as is the likelihood that debris from an explosion might cause injuries or seriously damage property. Moreover, a flash-bang projectile according to the invention does not require the user to actuate a timer. Instead, various mechanical features of the new flash-bang projectile after it has been released determine when it will be actuated. In addition, unlike conventional flash-bang projectiles, which typically provide only one flash of light and associated noise pulse, or "bang," when the projectile explodes, a flash-bang projectile according to the invention is capable of producing multiple "flashes" of light and multiple noise pulses, or "bangs." Furthermore, the timings of the flashes need not coincide with respective noise pulses, which can further augment the confusion that a flash-bang projectile in connection with the invention can provoke.

As noted above, the invention is directed to a flash-bang projectile that generates one or more noise pulses and one or more flashes of light. In one aspect of the invention, in connection with generating a noise pulse, the flash-bang projectile provides a housing that includes a gas chamber that entraps air. The gas chamber includes a compression device that, when the flash-bang projectile is shot or otherwise ejected by a gun or other form of ejection device, compresses the air that is entrapped in the gas chamber. A burst disk forms one wall of the gas chamber and is configured to rupture a selected time delay after the air has been compressed. Rupturing of the burst disk releases the compressed air entrapped in the gas chamber, allowing the air to be released through a horn nozzle, thereby generating a noise pulse. The flash-bang projectile may have more than one gas chambers, with associated compression devices, whose burst disks are configured to rupture with diverse time delays, in which case the flash-bang projectile can generate multiple noise pulses with corresponding delays.

In a second aspect of the invention, in connection with generate a light flash, the flash-bang projectile includes one or more light generating devices, which may include items such as flash lamps, light-emitting devices, and the like, along with a control module for powering the light generating devices. The control module includes an electrical generating arrangement that uses a portion of the kinetic energy imparted to the flash-bang projectile when it is ejected to generate electrical energy. The electrical energy is, in turn, used to power the light generating devices.

The two aspects of the invention, namely, the noise pulse generating aspect and the light flash generating aspect, may be used together in a flash-bang projectile, or each aspect can be used individually. For example, a flash-bang projectile that makes use of the noise pulse generating aspect of the invention may, instead of making use of the light flash generating aspect, may omit that aspect altogether. Alternatively, the flash-bang projectile may include a light flash generating arrangement that, for example, makes use of an electrical battery to power the light generating devices, instead of an electrical generating arrangement that uses the flash-bang projectile's kinetic energy to generate the electrical power. Similarly, a flash-bang projectile that makes use of the light flash generating arrangement, that is, the arrangement that uses the flash-bang projectile's kinetic energy to generate electrical power to generate the light flashes may omit the noise pulse generating aspect, or provide another type of arrangement for generating a noise pulse.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
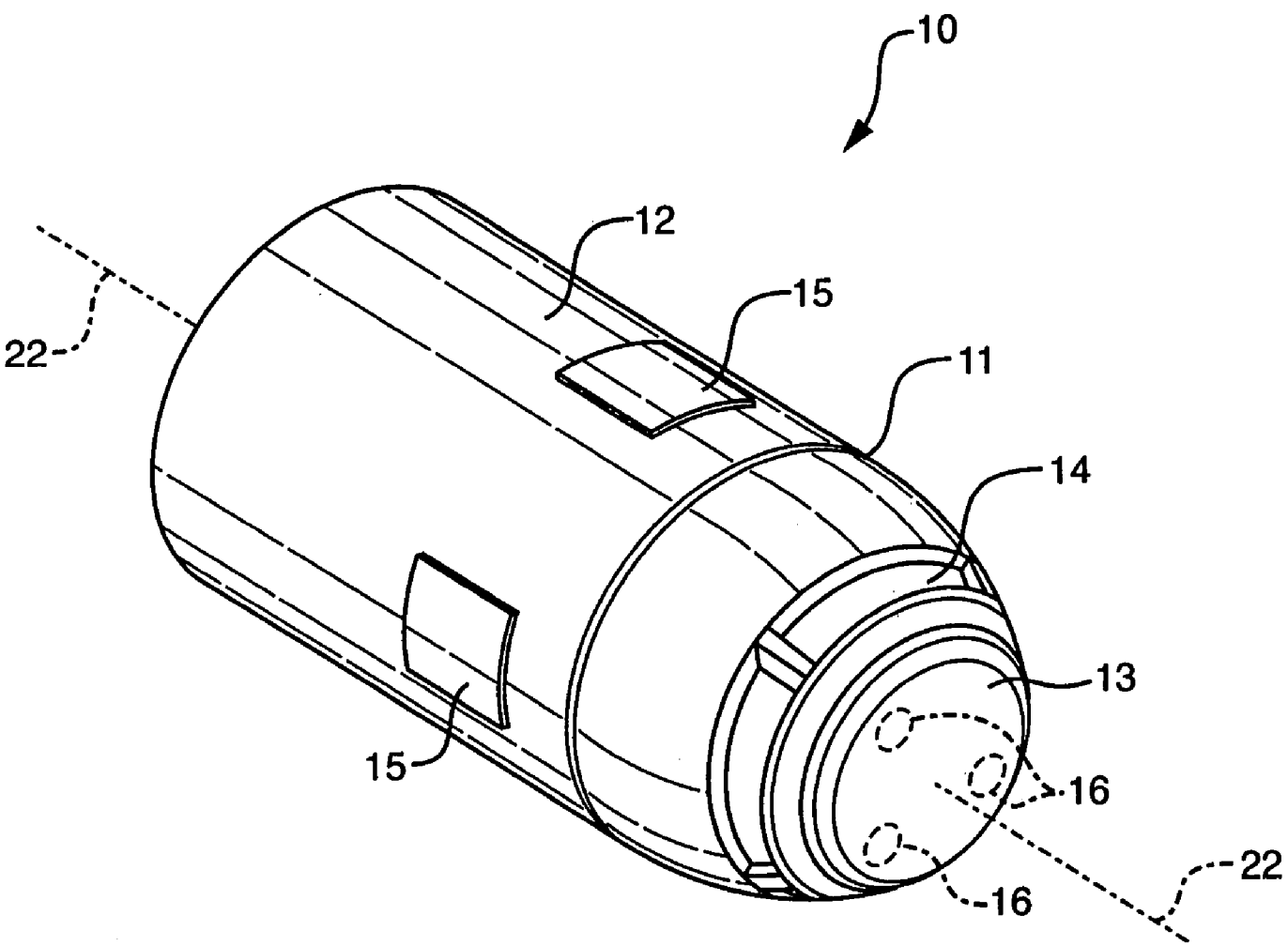
FIG. 1 depicts a flash-bang projectile constructed in accordance with the invention.
Figure 2:
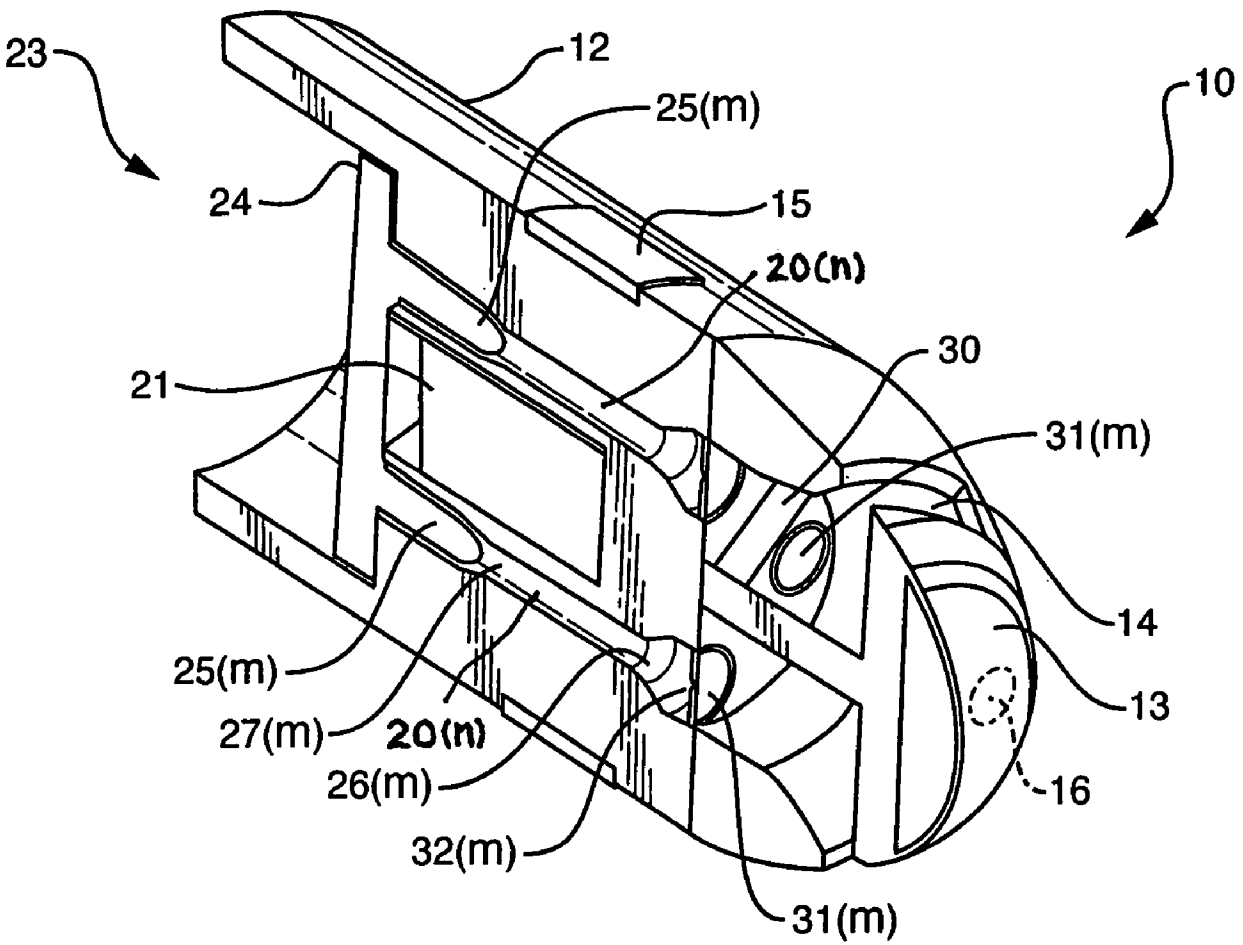
FIG. 2 is a side view, partially in section, of the flash-bang projectile depicted in FIG. 1.

FIG. 1 depicts a "flash-bang" projectile 10 constructed in accordance with the invention, and FIG. 2 depicts a side view, partially in section if the flash-bang projectile 10 depicted in FIG. 1. Generally, the flash-bang projectile 10 can be ejected or otherwise shot from, for example, a gun (not shown). After the flash-bang projectile 10 has been ejected, the flash-bang projectile 10 will emit one or more bright flashes of white light (each of which will be referred to as a "flash") and one or more loud bursts of noise (each of which will be referred to as a "sound pulse emission"). In addition to the bright flashes of white light, the flash-bang projectile 10 depicted in FIGS. 1 and 2 can emit flashes of multi-colored light. The flashes of white and/or multi-colored light may be synchronized with, or be generally contemporaneous with, the sound pulse emissions, or they may be at times independent of the bang emissions. As will be described below, neither the light flash or flashes nor the sound pulse emissions are provided by explosive charges, as is the case in connection with conventional flash-bang projectiles. Instead, the sound pulse emissions and light flashes are powered by kinetic energy that is imparted to the flash-bang projectile 10 when the projectile 10 it is ejected. Since the flash-bang projectile 10 does not make use of conventional explosive charges that generally provide the light flash and sound pulse, it can avoid a number of the problems that can arise in connection with conventional flash-bang projectiles.

With reference to FIGS. 1 and 2, flash-bang projectile 10 comprises an outer housing 11 that includes a generally cylindrical portion 12 along most of its length, with a blunt nose portion 13 towards the front (towards the right as shown in FIG. 2) of the flash-bang projectile 10. Formed in the nose portion 13 are one or more apertures that comprise acoustic ports 14, whose purposes which will be made clear below. Mounted in respective recesses in the exterior of the housing 11 are one or more flash lamps generally identified by reference numeral 15 and one or more light-emitting diodes generally identified by reference numeral 16. In the embodiment depicted in FIGS. 1 and 2, the flash lamps 15 are mounted on the exterior of the cylindrical portion 12 of the housing 11 approximately half-way along the length of the projectile 10. In that same embodiment, the light-emitting diodes 16 are mounted on the nose portion 13. It will be appreciated that the flash lamps 15 as well as the light-emitting diodes 16 may be mounted anywhere on the exterior of the housing 11. Preferably, the exterior surfaces of the flash lamps 15 and light-emitting diodes will be configured to provide a smooth exterior surface for the flash-bang projectile 10. As described below, the flash lamps 12, which in one embodiment comprise xenon lamps, can be actuated to provide respective bright "flashes" of generally white light. The light-emitting diodes 16 may be of diverse colors and, as will further be described below, may be actuated contemporaneously with, or independently of, the flash lamps 12 to provide further flashes of light of various colors. Preferably, the flash lamps 15 and/or light-emitting diodes 16 will generally be disposed generally symmetrically around the flash-bang projectile 10 so that, when they are energized, as described below, at least some of the flash lamps 15 or light-emitting diodes 16 will be visible from a variety of directions.

Continuing with FIGS. 1 and 2, formed within the interior the housing 11 are one or more air chambers 20(1) through 20(N) (generally identified by reference numeral 20(*n*)). In addition, a projectile control module 21 is mounted within the interior of the housing, with the air chambers 20(*n*) being formed symmetrically around the projectile control module 21. Generally, in the embodiment depicted in FIGS. 1 and 2, the flash-bang projectile 10 includes four gas chambers that are generally disposed symmetrically around the longitudinal axis 22 of the flash-bang projectile 10. Preferably, the control module 21 is positioned within the flash-bang projectile 10 so that the mass of the projectile 10, including the control module 21, will be uniformly distributed around the axis 22. The sidewalls that define the gas chambers 20(*n*) may conveniently be molded into the sidewall comprising the housing 11, or alternatively they may be formed separately from the housing and mounted therein using adhesives or the like.

The rear (the left, as depicted in FIGS. 1 and 2) ends of the gas chambers 20(*n*) are all sealed by a plunger system 23, comprising a rear plate 24 and a plurality of rods generally identified by reference numeral 25(*m*). In the embodiment depicted in FIGS. 1 and 2, each gas chamber 20(*n*) is associated with one rod 25(*m*), but it will be appreciated that one or more of the gas chambers 20(*n*) may be associated with a plurality of rods 25(*m*). The forward ends of the rods 25(*m*) are tapered to allow the rods to be easily slipped into the respective gas chambers 20(*n*) when the flash-bang projectile 10 is constructed, and the rods 25(*m*) are shaped and dimensioned to snugly fit into and effectively seal rear openings 27(*m*) of the respective gas chambers 20(*n*). As will be described below in more detail, prior to the firing of the flash-bang projectile 10, the plunger system 23 is displaced rearwardly of the position as shown in FIGS. 1 and 2, so that the forward ends 26(*m*) of the respective rods 25(*m*) will extend into the rear openings 27(*m*) of the respective gas chambers 20(*n*) a slight extent, but will, for the most part, be retracted.

The forward ends (towards the right, as depicted in FIGS. 1 and 2) of the gas chambers 20(*n*) are sealed by a plate 30 in which is mounted one or more burst disks generally identified by reference numeral 31(*m*), each of which covers a respective horn nozzle 32(*m*). At least one burst disk 31(*m*) and associated horn nozzle 32(*m*) is associated with each gas chamber 20(*n*), but it will be appreciated that multiple burst disks 31(*m*) and associated horn nozzles 32(*m*) may be associated with a particular gas chamber 20(*n*). For example, if the flash-bang projectile 10 includes one gas chamber 20, the plate 30 may be provided with a one burst disk 31(*m*) and horn nozzle 32(*m*), or alternatively a plurality of burst disks 31(*m*) and associated horn nozzles 32(*m*) may be mounted in the plate 30 and arrayed around the flash-bang projectile's horizontal axis 22. The burst disks 31(*m*) are formed of a material that will rupture after their respective sides have been subjected to a differential in air pressure for a particular period of time, with the time depending on, for example, the type of the material from which the burst disks 31(*m*) are formed, structural features such as their thicknesses, and other criteria as will be appreciated by those skilled in the art. It will be appreciated that the various burst disks 31(*n*) may be formed from the same materials, possibly with different thicknesses to provide for different rupture times. Alternatively, they may be formed from different materials, which also can provide for different rupture times. As noted above, positioned within the gas chambers 20(*n*), preferably just interiorly of the burst disks(*m*), are respective horn pipes or nozzles 32(*m*) that, when air flows therethrough after the respective burst disk 31(*m*) ruptures, will provide a sound pulse, substantially in the manner of a horn.

The control module 21 performs two general functions. First, the control module 21 generates electrical power that will be used to energize the flash lamps 15 and light-emitting diodes 16. The control module 21 may make use of a number of power generating devices, including, for example batteries, but various embodiments of the flash-bang projectile 10 make use of one or more power generating devices that make use of at least some of the kinetic energy that is imparted to the flash-bang projectile 10 when it is ejected in generating the electrical power. Several of these embodiments will be described below in connection with FIGS. 3A through 3C.

In addition, the control module 21 controls the times at which the respective flash lamps 15 and light-emitting diodes 16 will be energized. The control module 21 may control the times at which the flash lamps 15 and light-emitting diodes 16 are energized irrespective of the times at which the burst disks 31(*m*) rupture and to provide respective noise pulses. Alternatively, the control module 21 may enable various ones of the flash lamps 15 and/or light-emitting diodes 16 to be energized in synchrony with the rupturing of respective burst disks 31(*m*). If the control module 21 enables the flash lamps 15 and/or light-emitting diodes 16 to be energized in synchrony with the rupturing of respective burst disks 31(*m*), the energization may be contemporaneous with the disk rupture, or at particular times subsequent to the rupturing of the respective disks. An arrangement in which the control module 21 is enabled to control energization of the flash lamps 15 and/or light-emitting diodes 16 in relation to the rupturing of the burst disks 31(*m*) will be described below.

Figure 3:
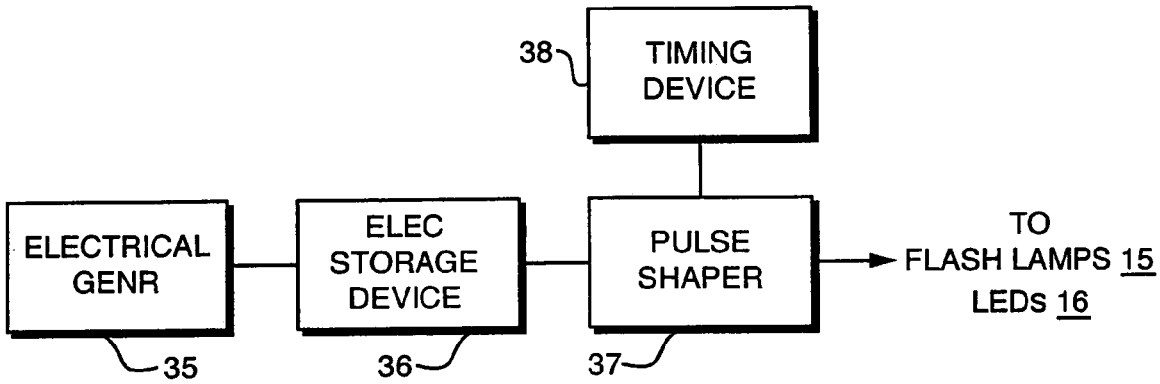
FIG. 3 is a functional block diagram of a control module for use in the flash-bang projectile depicted in FIG. 1.

A functional block diagram of a control module 21 for use in the flash-bang projectile 10 is depicted in FIG. 3. Generally, the control module 21 includes a number of elements including at least one electrical generator 35, at least one charge storage device 36, at least one pulse shaping circuit 37 and at least one timing device 38. The control module 21 may include one set of electrical generator 35, charge storage device 36, pulse shaping circuit 37 and timing device 37 associated with each flash lamp 15 or light-emitting diode 16. Alternatively, several of the components of the control module 21 may be associated with more than one of the flash lamps 15 and/or light-emitting diodes 16. If various components of the control module 21 are associated with more than one flash lamp 15 and/or light-emitting diode 16, it will be appreciated that the control module 21 will preferably also include such components (not shown) as may facilitate dividing electrical power among the flash lamps 15 and/or light-emitting diodes 16 to which they are connected, as well as for timing the respective flashes of the flash lamps 16 and/or light-emitting diodes 16.

Generally, the electrical generator 35 generates, from the kinetic energy imparted to the flash-bang projectile 10 when it is fired, electrical power that will be used to power the flash lamps 15 and light-emitting diodes 16. Several alternative embodiments for the electrical generator 35 will be described below in connection with FIGS. 3A through 3C. The electrical power that is generated by the electrical generator 35 is stored in the charge storage device 36 until it is used to power the flash lamps 15 and light-emitting diodes 16. In one embodiment, the charge storage device 31 includes, for example, a capacitor that stores electrical power in a conventional.

The timing device 38 controls the time or times at which power stored in the charge storage device 36 will be discharged to power the respective flash lamps 15 and light-emitting diodes 16. When the timing device 33 times out, it enables the pulse shaping circuit 37 to discharge the charge storage device 31 through the flash lamp(s) 15 and/or light-emitting diode(s) 16 to which it is connected so as to enable them to emit respective flashes of light. As noted above, in one embodiment, the control module 21 controls the flashes of light in relation to the rupturing of the respective burst disks 31(*m*). To accomplish that, the timing device 38 includes electrical circuits (not shown) that are traced on the respective burst disks 31(*m*). As will be described below in more detail, when the burst disk 31(*m*) ruptures, the circuit trace on the respective burst disk 31(*m*) is also ruptures, thereby breaking the electrical circuit that includes the circuit trace. The timing device 38 senses the break in the circuit trace on the burst disk 27(*m*) that has burst, and at that point can actuate the pulse shaping circuit 32 to enable it to enable electrical charge to be discharged from the charge storage device 31 through the flash lamp(s) 15 and/or light-emitting diode(s) 16 to which it is connected, thereby to enable them to flash. The discharge of the charge storage device 31 is in the form of an electrical pulse, and the pulse shaping circuit 32 is configured to shape the electrical pulse so as to be optimal for the particular flash lamp(s) 15 and/or light-emitting diode(s) 16 to which it is connected to provide for bright flash(es) of light. It will be appreciated that providing that the timing device 33 actuate the pulse shaping circuit 32 when a burst disk 27(*m*) bursts will generally enable light flash(es) to be synchronized with the noise pulse that accompanies the bursting of the burst disk 27(*m*). The timing device 33 can actuate the pulse shaping circuit 32 contemporaneous with the bursting of the burst disk 27(*m*) and accompanying noise pulse. Alternatively, the timing device 33 can actuate the pulse shaping circuit 32 with one or more selected time delays, so that the light flash(es) will occur with corresponding delays after the noise pulse. If the pulse shaping circuit 32 is connected to multiple flash lamp(s) 15 and/or light emitting diode(s) 16, the timing device 33 can actuate the pulse shaping circuit 32 to power the flash lamp(s) and/or light emitting diode(s) all at the same time, or at different times, with the same or different time delays.

Figure 3A:
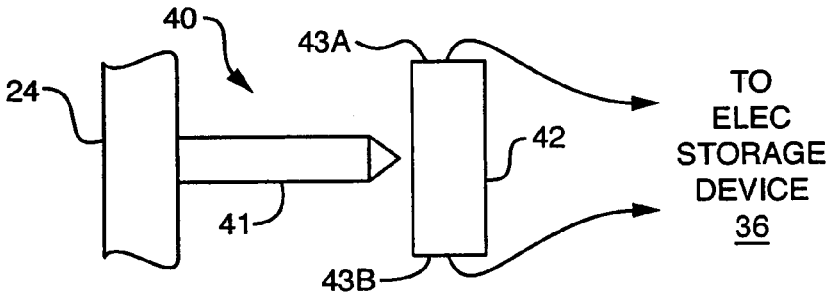
FIGS. 3A through 3C are functional block diagrams of respective embodiments of electrical generators for use in connection with the control module depicted in FIG. 3.
Figure 3B:
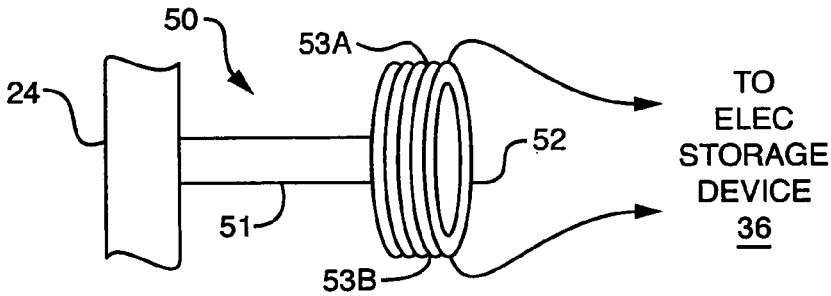
Figure 3C:
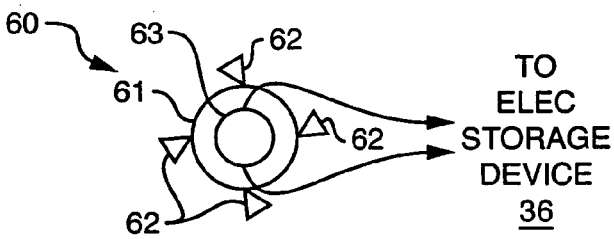

As noted above, in one embodiment, the electrical generator 35 included in the control module 21 may be powered by an electrical battery, but in one embodiment the generator 35 makes use of kinetic energy imparted to the flash-bang projectile 10 when it is ejected to generate the electrical energy. FIGS. 3A through 3C depict functional block diagrams of illustrative embodiments of an electrical generator 35 that may be used in the control module 21. Two of the illustrative embodiments, namely the generator 40 depicted in FIG. 3A and the generator 50 depicted in FIG. 3B, make use of additional rods 41, 51 that are mounted on the plate 24 (FIG. 2). In the embodiment depicted in FIG. 3A, the electrical generator 40 also includes a piezoelectric crystal 42, and power is generated by the striking of rod 41, which operates as an impact hammer, on a surface of the piezoelectric crystal 42. The impact of the rod 41 on the surface causes the crystal 42 to generate a voltage across its two ends 43A, 43B, and the resulting electrical power is provided to the electrical storage device 31 for storage.

In the embodiment depicted in FIG. 3B, the rod 51 is in the form of a permanent magnet. In addition to the magnet, the electrical generator 50 includes a wire coil 52, and the electrical generator generates electrical power by the thrusting of the magnet on rod 51 through the wire coil 52 when the plate 24 is forced forward when the plate is ejected. The movement of the magnetic field, provided by the rod 51, relative to the wire coil 52 causes a voltage to be developed across the two ends 53A, 53B of the coil 52, and the resulting electrical power is provided to the electrical storage device 31 for storage.

In the embodiment depicted in FIG. 3C, on the other hand, the generator 60 makes use of air flow through and/or around the flash-bang projectile 10 after it has been ejected to generate electrical power. The generator 60 includes a turbine 61 whose fan blades 62 entrain air flowing past or through the flash-bang projectile 10, which causes the turbine 61 to rotate. The rotation of the turbine 61, in turn, powers an electrical generating device 63 in a conventional manner. An opening (not shown) may be provided through the flash-bang projectile 10, preferably along the axis 22, to facilitate air flow through the turbine 61. Alternatively, or in addition, the turbine can be provided with a fan that extends beyond the diameter of the housing 11 after the flash-bang projectile 10 has been ejected, to entrain air flowing along the sidewalls of the housing 11.

Other devices that may find use as electrical generator 35 for the control module 21 will be apparent to those skilled in the art. For example, as noted above, electrical batteries may be useful in providing electrical power for use in powering the flash lamps and the light-emitting diodes. Alternatively or in addition, flash-bang projectile 10 may include multiple devices for providing power. For example, flash-bang projectile 10 may include an electrical generator 35 such as one described above in connection with FIGS. 3A through 3C, power generated by which may be augmented by an electrical battery.

With this background, the operation of the flash-bang projectile 10 will now be described. As noted above, the flash-bang projectile 10 is initially configured with the plate 24 and associated rods 25(*m*) retracted (that is, toward the left, as shown in FIG. 2). In that condition, the rods 25(*m*) are substantially retracted from the respective gas chambers 20(*n*) although the forward ends of the rods 25(*m*) are partially inserted into the rear ends of the gas chambers 20(*n*) so that, when the flash-bang projectile 10 is ejected and the plate 24 pushed forward, the rods 25(*m*) will be thrust forward into the gas chambers 20(*n*) to compress the gas contained therein. In addition, if the control module 21 makes use of arrangements such as those described above in connection with FIGS. 3A and 3B, the rod or rods associated with the electrical generator 35 are retracted from the piezoelectric crystal 42 or coil 52, so that, when the respective rods are thrust forward when the plate 24 is pushed forward when the flash-bang projectile 10 is ejected, the generator 35 will be enabled to generate electrical power to power the flash lamps 15 and light-emitting diodes 16.

As noted above, the flash-bang projectile 10 is shot or otherwise ejected by an ejection device (not shown), such as a gun or the like. When the ejection device ejects the flash-bang projectile 10, in addition to propelling the flash-bang projectile 10 forward, the force of the ejection also forces the plate 24 forward, that is, towards the right as shown in FIG. 2. When the plate 24 is forced forward, the rods 25(*m*) are also forced forward, thereby to enable them to reduce the volume of the respective gas chambers 20(*n*), which serves compress the gas that is entrapped therein. In addition, if the electrical generator 35 makes use of an arrangement similar to those described above in connection with FIGS. 3A and 3B, the rod or rods 25(*m*) that are associated with the generator 35 are also forced forward. If, for example, the electrical generator 35 is in the form described above in connection with FIG. 3A, when the plate 24 is forced towards the front (towards the right, as shown in FIG. 3A), a rod 25(*m*) affixed thereto strikes the piezoelectric crystal 42, which, in turn, generates electrical power that is provided to the electrical storage device 36 for storage. On the other hand, if the electrical generator 35 is in the form described above in connection with FIG. 3B, when the plate 24 is forced towards the front, a rod 25(*m*) affixed thereto forces the permanent magnet through the coil 52, thereby generating electrical power that is provided to the electrical storage device 36 for storage. On the other hand, if the if the electrical generator 35 is in the form described above in connection with FIG. 3C, the air entrained with the turbine fan 61 actuates the electrical generating device 62 to generate electrical power. In any case, the power that is generated by the electrical generator 35 is provided to the electrical storage device 36 for storage.

The projection of the rods 25(*m*) into the respective gas chambers 20(*n*) result in a significant increase in the pressure of the air that is entrapped in the respective gas chambers 20(*n*). At some point in time after the flash-bang projectile 10 has been ejected, the increased air pressure in at least one of the gas chambers 20(*n*) causes the burst disk 31(*m*) associated therewith to rupture a selected time after the pressure increase, the time being determined by factors such as the materials of which the respective burst disk is constructed, structural features such as its thickness, and other criteria so forth. The rupturing of the burst disk 31(*m*), in turn, allows the air that is entrapped in the respective gas chamber 20(*n*) to be released through the horn nozzle 32(*m*), thereby causing generation of a noise pulse that is radiated outwardly through the acoustic ports 14 toward the front of the nose portion 12.

In addition, the rupturing of the respective burst disk 31(*m*) breaks the electrical trace on the respective burst disk. The rupturing of the trace is sensed by the timing device 38, which, in turn, causes the pulse shaping circuit 37 to discharge power from the to power one or more of the flash lamps 15 and/or light-emitting diodes 16, thereby to generate a light flash.

If the flash-bang projectile 10 has multiple gas chambers 20(*n*) with respective burst disks 24(*m*), operations similar to those described above will occur for each gas chamber 20(*n*) in generating respective noise pulses. As noted above, the structural features of the respective burst disks 24(*m*) may provide diverse time delays to facilitate generation of noise pulses by the flash-bang projectile 10 at multiple points in time. Similarly, if multiple ones of the burst disks 24(*m*) are provided with traces, the timing device 38 can sense the rupturing of the respective traces and enable the pulse shaping circuit 37 to discharge through respective ones of the flash lamps 15 and/or light-emitting diodes 16.

A flash-bang projectile in accordance with the invention provides a number of advantages. For example, a flash-bang projectile 10 in connection with the invention does not make use of explosive charges or the like, which could injure people and damage property, to generate the noise pulses and light flashes that are to be produced by the respective device. An flash-bang projectile 10 according to the invention can make use of the kinetic energy that is imparted thereto when the projectile is ejected to condition itself to generate the noise pulse(s) and light flash(es) that are to be generated by the flash-bang projectile 10. In addition, since the flash-bang projectile 10 can make use of multiple gas chambers 20(*n*), each with a respective burst disk 31(*m*) and horn nozzle 32(*m*), an flash-bang projectile 10 in accordance with the invention can generate multiple noise pulses at diverse points in time. Furthermore, an flash-bang projectile 10 in accordance with the invention can generate one or more flashes of light, generally at points in time that are in relation to the noise pulse(s).

It will be appreciated that a number of modifications and changes may be made to the flash-bang projectile 10 described above. For example, although the flash-bang projectile 10 has been described as including both an arrangement for generating one or more noise pulses and one or more light flashes, it will be appreciated that a projectile in accordance with the invention include an arrangement for generating one or more noise pulses, or alternatively an arrangement for generating one or more light flashes.

In addition, it will be appreciated that, if the acoustic port 14 itself is configured to generate a noise pulse, in the nature of a horn, in response to air flowing therethrough, horn nozzles associated with the individual burst disks need not be provided.

Furthermore, although the flash-bang projectile 10 has been described as having a particular configuration or contour for the housing 11 of the flash-bang projectile 10, in particular the cylindrical portion 12 and blunt nose portion 13, it will be appreciated that the housing 11 may have a configuration that differs from that described herein.

In addition, although the flash-bang projectile 10 has been described as having particular kinds of devices, namely, xenon lamps as the flash lamps 15 and light-emitting diodes as the lights 16, it will be appreciated that other types of devices may be provided. Furthermore, a flash-bang projectile 10 in accordance with the invention may be provided with one or more flash lamps 15 and no light-emitting diodes 16, or one or more light-emitting diodes 16 and no flash lamps 15.

Furthermore, it will be appreciated that other arrangements may be provided to for use as electrical generator 35.

In addition, it will be appreciated that, although the flash-bang projectile 10 was described as having the burst disks 31(*m*) and associated horn nozzles 32(*m*) mounted in the plate 30 forming the forward ends of the gas chambers 20(*n*), it will be appreciated that burst disks 31(*m*) and associated horn nozzles 32(*m*) may instead or in addition be mounted in the sidewall comprising the cylindrical portion 12 or elsewhere along the respective gas chambers 20(*n*). It will be appreciated that, if burst disks 31(*m*) are mounted in the sidewall, when they burst the air escaping from the respective gas chambers 20(*m*) may force the flash-bang projectile 10 to deviate from its normal trajectory, which may be desirable in enhancing confusion that might otherwise be provoked thereby.

It will further be appreciated that the flash-bang projectile 10 may be fabricated from any appropriate materials.

The foregoing description has been limited to a specific embodiment of this invention. It will be apparent, however, that various variations and modifications may be made to the invention, with the attainment of some or all of the advantages of the invention. It is the object of the appended claims to cover these and such other variations and modifications as come within the true spirit and scope of the invention.

What is claimed as new and desired to be secured by Letters Patent of the United States is:

1. A projectile configured to generate at least one noise pulse following ejection by an ejection device, the projectile comprising a housing defining at least one gas chamber configured to entrap gas, the gas chamber having at least one sidewall having mounted therein a horn nozzle and an associated burst disk, and a gas compressor configured to compress the gas entrapped in the gas chamber after the projectile has been ejected, the burst disk being configured to rupture after the gas in the gas chamber has been compressed for a selected time thereby to allow the gas in the gas chamber to be forced through the horn nozzle thereby to emit a noise pulse.

2. A projectile as defined in claim 1 in which

A. the gas chamber comprises an elongated chamber defined in the housing; and

B. the gas compressor comprises a plunger system that, in response to the force of ejection, forces a rod into the chamber, thereby to reduce the volume of the gas chamber, the reduction of volume facilitating an increase in pressure of the gas entrapped in the gas chamber.

3. A projectile as defined in claim 1 in which the housing defines a plurality of gas chambers, each of which is configured to entrap gas, each gas chamber having at least a portion of a sidewall associated therewith having mounted therein a burst disk and associated horn nozzle, the gas compressor being configured to compress the gas entrapped in the respective gas chambers after the projectile has been ejected, each burst disk being configured to rupture after the gas in the gas chamber has been compressed for a selected time thereby to allow the gas in the gas chamber to be forced through the associated horn nozzle thereby to emit a noise pulse.

4. A projectile as defined in claim 3 in which at least two burst disks are configured to rupture after diverse selected times, thereby to facilitate emission of noise pulses at at least two points in time.

5. A projectile as defined in claim 3 in which

A. each gas chamber comprises an elongated chamber defined in the housing; and

B. the gas compressor comprises a plunger system that, in response to the force of ejection, forces a rod into each chamber, thereby to reduce the volume of the respective gas chamber, the reduction of volume in the respective gas chamber facilitating an increase in pressure of the gas entrapped in the respective gas chamber.

6. A projectile as defined in claim 3 in which the gas chambers are symmetrically disposed around an axis of the housing.

7. A projectile as defined in claim 1 in which the housing defines a cavity having an opening and the gas compressor includes a rod having an end extending into the opening, the rod being configured to be projected into the cavity when the projectile is ejected to reduce the volume of the cavity and thereby increase the pressure of the case entrapped in the cavity.

8. A projectile as defined in claim 7 in which the control module includes an electrical power generating arrangement configured to generate electrical power following ejection and a power supply control arrangement configured to control the provision of the electrical power to the light generating device.

9. A projectile as defined in claim 8 in which the electrical power generating arrangement is configured to generate the electrical power from kinetic energy imparted to the projectile during ejection.

10. A projectile as defined in claim 9 in which the electrical power generating arrangement includes a piezoelectric crystal and a rod, the rod being configured to strike the piezoelectric crystal during ejection thereby to enable the piezoelectric crystal to generate electrical power.

11. A projectile as defined in claim 9 in which the electrical power generating arrangement includes a wire and a magnet, the magnet having a magnetic field and the wire being positioned to intercept the magnetic field, the wire and magnet being enabled to move relative to each other during ejection thereby to enable the wire to generate electrical power.

12. A projectile as defined in claim 11 in which the wire is in the form of a coil.

13. A projectile as defined in claim 9 in which the electrical power generating arrangement includes an electrical generator and a turbine, the turbine being configured to entrain air flowing past the projectile following ejection, the entrained air enabling the turbine to rotate, the electrical generator being configured to generate electrical power in response to rotation of the turbine.

14. A projectile as defined in claim 1 further comprising at least one electrically-energizable light generating device mounted on the exterior of the housing and a control module, the control module being configured to energize the light generating device following ejection thereby to enable the light generating device to generate a light flash.

15. A projectile as defined in claim 14 in which the control module is configured to energize the light generating device at a time in relation to the emission of the noise pulse.

16. A projectile as defined in claim 15 further comprising a sensor configured to sense the rupturing of the burst disk, the sensor being configured to control the control module to energize the light generating device in relation to the rupturing of the burst disk.

17. A projectile as defined in claim 1, the projectile being further configured to generate at least one light flash following ejection by an ejection device, the projectile housing having a light generating device mounted thereon and a control module, the control module being configured to generate electrical power following ejection and energize the light generating device thereby to enable the light generating device to generate a light flash.

18. A projectile as defined in claim 17 in which the control module includes an electrical power generating arrangement configured to generate electrical power following ejection and a power supply control arrangement configured to control the provision of the electrical power to the light generating device.

19. A projectile as defined in claim 18 in which the electrical power generating arrangement is configured to generate the electrical power from kinetic energy imparted to the projectile during ejection.

20. A projectile as defined in claim 19 in which the electrical power generating arrangement includes a wire and a magnet, the magnet having a magnetic field and the wire being positioned to intercept the magnetic field, the wire and magnet being enabled to move relative to each other during ejection thereby to enable the wire to generate electrical power.

21. A projectile as defined in claim 19 in which the electrical power generating arrangement includes an electrical generator and a turbine, the turbine being configured to entrain air flowing past the projectile following ejection, the entrained air enabling the turbine to rotate, the electrical generator being configured to generate electrical power in response to rotation of the turbine.

22. A projectile as defined in claim 17 in which the control module energizes the light generating device in synchrony with the rupture of the burst disk.

23. A projectile as defined in claim 22 in which the control module includes a timing device including an electrical circuit trace on the burst disk, the electrical circuit trace rupturing upon the rupture of the burst disk, the timing device being operative to sense the rupture of the electrical circuit trace and, in response, enable the energizing of the light generating device.

24. A projectile configured to generate at least one light flash following ejection by an ejection device, the projectile comprising a housing having a light generating device mounted thereon and a control module, the control module being configured to generate electrical power following ejection and energize the light generating device thereby to enable the light generating device to generate a light flash, in which the control module includes an electrical power generating arrangement configured to generate electrical power following ejection and a power supply control arrangement configured to control the provision of the electrical power to the light generating device, in which the electrical power generating arrangement is configured to generate the electrical power from kinetic energy imparted to the projectile during ejection, and in which the electrical power generating arrangement includes a piezoelectric crystal and a rod, the rod being configured to strike the piezoelectric crystal during ejection thereby to enable the piezoelectric crystal to generate electrical power.

25. A projectile as defined in claim 24, the projectile being configured to generate at least one noise pulse following ejection by the ejection device, the projectile housing defining at least one gas chamber configured to entrap gas, the gas chamber having at least one sidewall having mounted therein a horn nozzle and an associated burst disk, and a gas compressor configured to compress the gas entrapped in the gas chamber after the projectile has been ejected, the burst disk being configured to rupture after the gas in the gas chamber has been compressed for a selected time thereby to allow the gas in the gas chamber to be forced through the horn nozzle thereby to emit a noise pulse.

26. A projectile as defined in claim 25 in which the control module energizes the light generating device in synchrony with the rupture of the burst disk.

27. A projectile as defined in claim 26 in which the control module includes a timing device including an electrical circuit trace on the burst disk, the electrical circuit trace rupturing upon the rupture of the burst disk, the timing device being operative to sense the rupture of the electrical circuit trace and, in response, enable the energizing of the light generating device.

28. A projectile configured to generate at least one light flash following ejection by an ejection device, the projectile comprising a housing having a light generating device mounted thereon and a control module, the control module being configured to generate electrical power following ejection and energize the light generating device thereby to enable the light generating device to generate a light flash, in which the control module includes an electrical power generating arrangement configured to generate electrical power following ejection and a power supply control arrangement configured to control the provision of the electrical power to the light generating device, in which the electrical power generating arrangement is configured to generate the electrical power from kinetic energy imparted to the projectile during ejection, in which the electrical power generating arrangement includes a wire and a magnet, the magnet having a magnetic field and the wire being positioned to intercept the magnetic field, the wire and magnet being enabled to move relative to each other during ejection thereby to enable the wire to generate electrical power, and in which the wire is in the form of a coil.

* * * * *